US006209996B1

(12) United States Patent
Gasvoda et al.

(10) Patent No.: US 6,209,996 B1
(45) **Date of Patent: *Apr. 3, 2001**

(54) METHOD AND APPARATUS FOR SECURING AN INK CONTAINER

(75) Inventors: Eric L. Gasvoda, Salem; Susan M. Hmelar, Corvallis, both of OR (US); Richard H. Lewis, Barcelona (ES)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/333,784

(22) Filed: Jun. 15, 1999

Related U.S. Application Data

(63) Continuation of application No. 08/869,150, filed on Jun. 4, 1997, now Pat. No. 5,949,459.

(51) Int. Cl.[7] ..... B41J 2/175
(52) U.S. Cl. ..... 347/86
(58) Field of Search ..... 347/84, 85, 86, 347/87, 7

(56) References Cited

U.S. PATENT DOCUMENTS

| | | | |
|---|---|---|---|
| 3,371,350 | 2/1968 | Sanderson et al. | 346/140.1 |
| 3,950,761 | 4/1976 | Kashio | 347/85 |
| 4,183,031 | 1/1980 | Kyser et al. | 347/86 |
| 4,422,084 | 12/1983 | Saito | 347/7 |
| 4,432,005 | 2/1984 | Duffield et al. | 347/86 |
| 4,506,276 | 3/1985 | Kyser et al. . | |
| 4,511,906 | 4/1985 | Hara | 347/7 |
| 4,558,326 | 12/1985 | Kimura et al. | 347/30 |
| 4,568,954 | 2/1986 | Rosback | 347/86 |
| 4,604,633 | 8/1986 | Kimura et al. | 346/30 |
| 4,639,738 | 1/1987 | Young et al. | 346/75 |
| 4,714,937 | 12/1987 | Kaplinsky | 347/86 |
| 4,760,409 | 7/1988 | Kiyohara et al. | 347/7 |
| 4,977,413 | 12/1990 | Yamanaka et al. | 347/7 |
| 5,137,379 | 8/1992 | Ukai et al. | 400/121 |
| 5,500,664 * | 3/1996 | Suzuki et al. | 347/86 |

(List continued on next page.)

FOREIGN PATENT DOCUMENTS

| | | | |
|---|---|---|---|
| 03184873 | 8/1991 | (EP) | B41J/2/175 |
| 0655336A1 | 11/1994 | (EP) | B41J/2/175 |
| 08039826 | 2/1996 | (EP) | B41J/2/175 |
| 0765757A2 | 4/1997 | (EP) | B41J/2/175 |
| 09323429 | 12/1997 | (EP) | B41J/2/175 |

*Primary Examiner*—N. Le
*Assistant Examiner*—Anh T. N. Vo
(74) *Attorney, Agent, or Firm*—Kevin B. Sullivan

(57) ABSTRACT

A replaceable ink container for providing ink to a printing device. The ink container having leading and trailing edges with respect to an insertion direction for the ink container into the printing device. The ink container includes a fluid outlet disposed on the leading edge and configured for connection to corresponding printing device fluid inlet. The ink container also includes an engagement feature disposed toward the trailing edge and extending outwardly from an ink container outer surface. The engagement feature is configured for insertion into a recessed engagement feature associated with the printing device. With the ink container properly positioned within the printing device and biased in a direction opposite the insertion direction, the engagement feature associated with the ink container engages the recessed engagement feature associated with the printing device. The engagement of the engagement features on each of the ink container and printer maintains the fluid outlet in engagement with the corresponding printing device fluid inlet.

21 Claims, 8 Drawing Sheets

U.S. PATENT DOCUMENTS

| | | | |
|---|---|---|---|
| 5,506,611 | 4/1996 | Ujita et al. | 347/86 |
| 5,552,816 | 9/1996 | Oda et al. | 347/86 |
| 5,574,489 | 11/1996 | Cowger et al. | 347/86 |
| 5,619,239 | 4/1997 | Kotaki et al. | 347/86 |
| 5,734,401 | 3/1998 | Clark et al. | 347/86 |
| 5,777,646 | 7/1998 | Barinaga et al. | 347/86 |
| 5,825,387 | 10/1998 | Cowger et al. | 347/86 |
| 5,844,579 * | 12/1998 | Barinaga et al. | 347/7 |
| 5,880,764 | 3/1999 | Barinaga | 347/86 |

* cited by examiner

METHOD AND APPARATUS FOR SECURING AN INK CONTAINER

CROSS-REFERENCES TO RELATED APPLICATIONS

This is a continuation of application Ser. No. 08/869,150 filed on Jun. 4, 1997 now U.S. Pat. No. 5,949,459.

This application is related to commonly assigned co-pending patent application, Ser. No. 08/869,038 filed herewith, entitled "Electrical Interconnect for Replaceable Ink Containers" incorporated herein by reference, and is related to commonly assigned co-pending patent application, Ser. No. 08,871,566, filed herewith, entitled "Replaceable Ink Container Adapted to Form Reliable Fluid, Air and Electrical Connection to a Printing System " incorporated herein by reference, and is related to commonly assigned co-pending patent application, Ser. No. 08,869, 240, filed herewith, entitled "Ink Container with an Inductive Ink Level Sense" incorporated herein by reference, and is related to commonly assigned co-pending patent application, Ser. No. 08/869,122, filed herewith, entitled "Ink Level Estimation Using Drop Count and Ink Level Sense" incorporated herein by reference, and is related to commonly assigned co-pending patent application, Ser. No. 08/868,773, filed herewith, entitled "Ink Container Providing Pressurized Ink with Ink Level Sensor" incorporated herein by reference and is related to commonly assigned co-pending patent application, Ser. No. 08/868,927, filed herewith, entitled "An Ink Container Having a Multiple Functioned Chassis" incorporated herein by reference and is related to commonly assigned co-pending patent application, Ser. No. 08/869,023, filed herewith, entitled "High Performance Ink Container with Efficient Construction" incorporated herein by reference.

BACKGROUND OF THE INVENTION

The present invention relates to ink-jet printing systems, and more particularly, ink-jet printing systems which make use of ink containers that are replaceable separate from a printhead.

Inkjet printers frequently make use of an ink-jet printhead mounted to a carriage which is moved back and fourth across a print media, such as paper. As the printhead is moved across the print media, a control system activates the printhead to eject or jet ink droplets onto the print media to form images and text.

Previously used printers have made use of an ink container that is separably replaceable from the printhead. When the ink cartridge is exhausted the ink cartridge is removed and replaced with a new ink container. The use of replaceable ink containers that are separate from the printhead allow users to replace the ink container without replacing the printhead. The printhead is then replaced at or near the end of printhead life and not when the ink container is exhausted.

One type of ink container spaced from the printhead is disclosed in U.S. Pat. No. 4,558,326 entitled "Purging System for Ink Jet Recording Apparatus" to Kimura et al. discloses the use of a replaceable ink cartridge having a hermetically sealed ink container bag disposed therein. Kimura makes use of the selective application of compressed air to the ink cartridge for pressurizing the ink container bag for forcing ink through a recording head thereby purging bubbles or solid matter from the ink flow path. Another type of ink cartridge is disclosed in U.S. Pat. No. 4,568,954 entitled "Ink Cartridge Manufacturing Method and Apparatus" to Rosback. The Rosback cartridge is a replaceable ink cartridge that is pressurizable.

There is an ever present need for ink containment systems that are capable of providing ink at high flow rates to a printhead thereby allowing high throughput printing. This ink supply system should be cost effective to allow relatively low cost per page printing. In addition, the ink supply should be capable of providing ink at high flow rates in a reliable manner to the printhead.

These ink supplies should be easily replaceable as well as form reliable fluid connection with the printing device while minimizing or eliminating ink spillage which can reduce the reliability of the printing device. The ink supply should be capable of forming additional interconnects such as electrical as well as pressurized gas interconnects between the printing device and the ink container.

SUMMARY OF THE INVENTION

A replaceable ink container for providing ink to a printing device. The ink container has leading and trailing edges with respect to an insertion direction for the ink container into the printing device. The ink container includes a fluid outlet disposed on the leading edge and configured for connection to corresponding printing device fluid inlet. The ink container also includes an engagement feature disposed toward the trailing edge and extending outwardly from an ink container outer surface. The engagement feature is configured for insertion into a recessed engagement feature associated with the printing device. With the ink container properly positioned within the printing device and biased in a direction opposite the insertion direction, the engagement feature associated with the ink container engages the recessed engagement feature associated with the printing device. The engagement of the engagement features on each of the ink container and printer maintain the fluid outlet in engagement with corresponding printing device fluid inlet.

In one preferred embodiment the engagement feature associated with the ink container extends downwardly relative to a gravitational frame of reference. In this preferred embodiment the recessed engagement feature associated with the printing device defines a hook that is configured for engaging the engagement feature associated with the ink container. In this embodiment the ink container includes a pressurized gas inlet electrical contacts for connection with corresponding gas outlet and electrical contacts, respectively, associated with the printing device.

DETAILED DESCRIPTION OF THE PREFERRED EMBODIMENT

Figure 1:
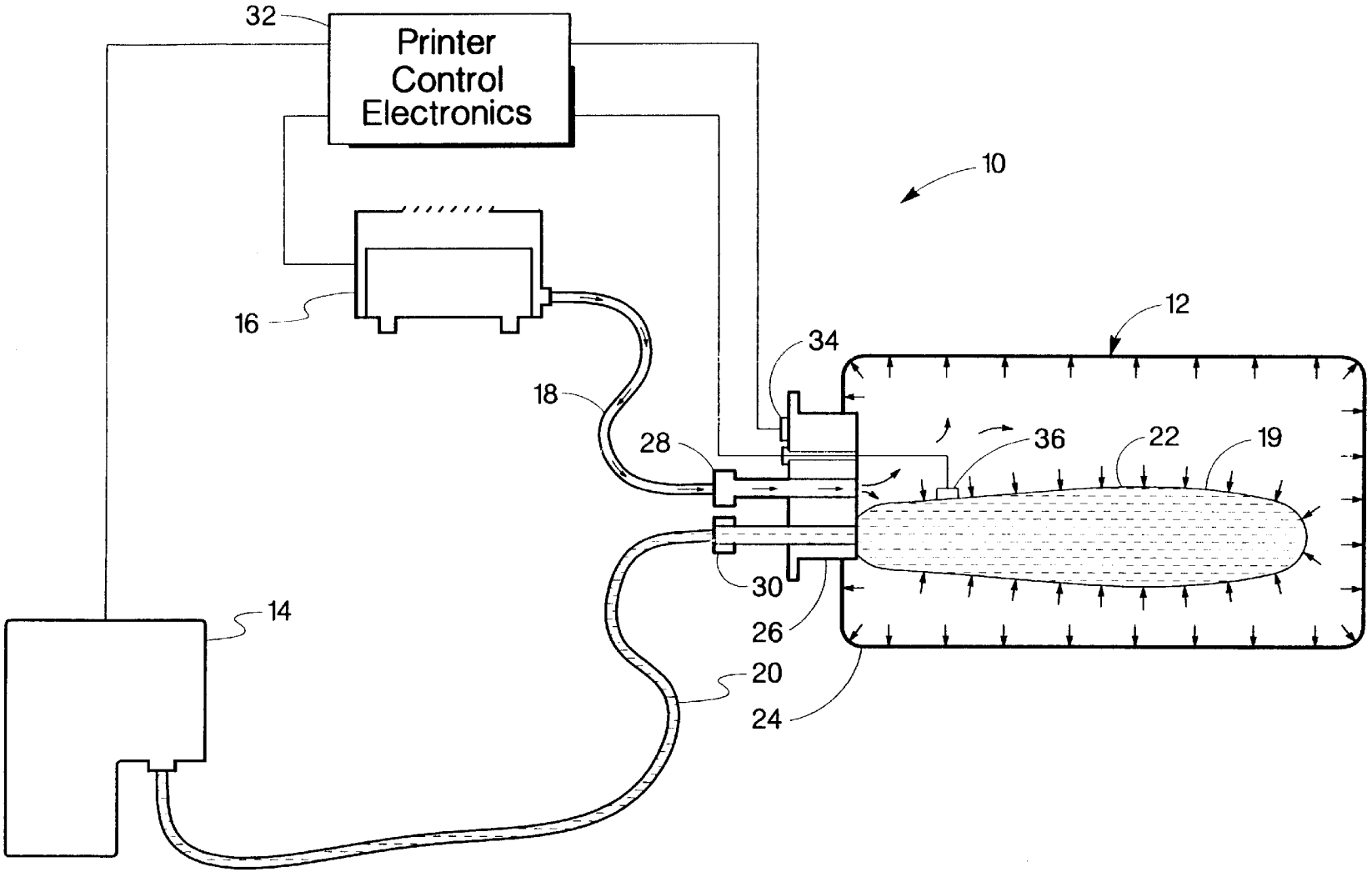
FIG. 1 depicts a schematic representation of a printing system that includes an ink container of the present invention.

FIG. 1 depicts a schematic representation of a printing system, printing device or printer 10 which includes the ink container 12 of the present invention. Also included in the printing device 10 is a printhead 14 and a source of pressurized gas such as a pump 16. The pump 16 is connected by a conduit 18 for providing a pressurized gas such as air to the ink container 12. A marking fluid 19 such as ink is provided by the ink container 12 to the printhead 14 by a conduit 20. This marking fluid is ejected from the printhead 14 to accomplish printing.

The ink container 12 which is the subject of the present invention includes a fluid reservoir 22 for containing ink 19, an outer shell 24, and a sealing portion or cap 26. In the preferred embodiment the cap 26 includes an air inlet 28 configured for connection to conduit 18 for pressurizing the outer shell 24 with air. A fluid outlet 30 is also included in the cap 26. The fluid outlet 30 is configured for connection to the conduit 20 for providing a fluid connection between the fluid reservoir 22 and fluid conduit 20.

In the preferred embodiment the fluid reservoir 22 is formed from a flexible material such that pressurization of the outer shell produces a pressurized flow of ink from the fluid reservoir 22 through the conduit 20 to the printhead 14. The use of a pressurized source of ink in the fluid reservoir 22 allows for a relatively high fluid flow rates from the fluid reservoir 22 to the printhead 14. The use of high flow rates or high rates of ink delivery to the printhead make it possible for high throughput printing by the printing system 10.

In the preferred embodiment, the ink container 12 also includes a plurality of electrical contacts, as will be discussed in more detail with respect to FIG. 3. The electrical contacts provide electrical connection between the ink container 12 and printer control electronics 32. The printer control electronics 32 controls various printing system 10 functions such as, but not limited to, printhead 14 activation to dispense ink and activation of pump 16 to pressurize the ink container 12. In one preferred embodiment the ink container 12 includes an information storage device 34 and an ink level sensing device or ink volume sensing decice 36. The information storage device 34 provides information to the printer control electronics for controlling printer 10 parameters such as ink container 12 volume as well as ink characteristics, to name a few. The ink level sensing device 36 provides information relating to current ink volume in the ink container 12 to the printer control electronics 32.

Figure 2:
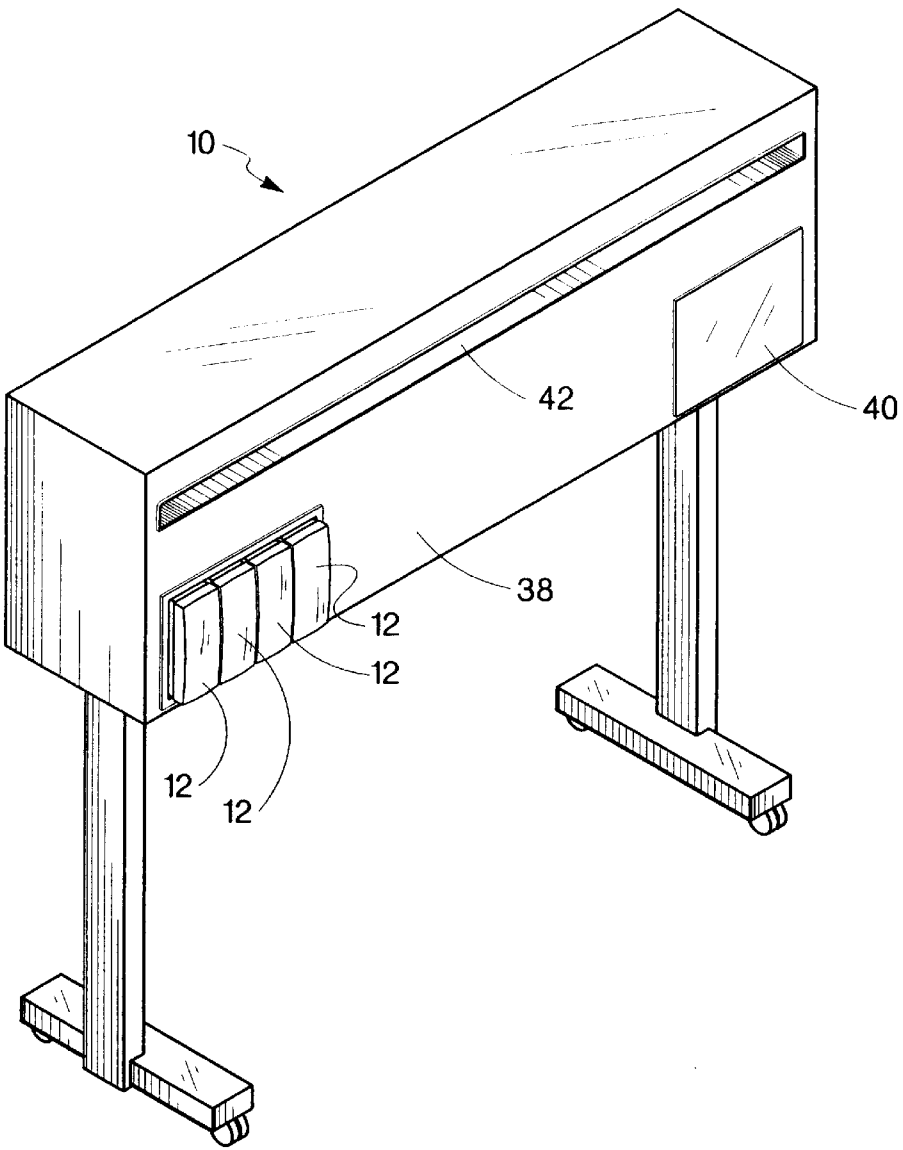
FIG. 2 depicts a perspective view of a representation of the printing system of FIG. 1.

FIG. 2 depicts one embodiment of the printing system 10 shown in perspective. The printing system 10 includes a printing chassis or printer chassis 38 containing one or more ink containers 12 of the present invention. The embodiment shown in FIG. 2 is shown having four similar ink containers 12. In this embodiment, each ink container contains a different ink color. Therefore, four color printing is accomplished by providing cyan, yellow, magenta and black ink from the four ink containers 12 to one or more printheads 14. Also included in the printer chassis 38 is a control panel 40 for controlling operation of the printer 10 and a media slot 42 from which print media such as paper is ejected.

As ink 19 in each ink container 12 is exhausted the ink container 12 is replaced with a new ink container 12 containing a new supply of ink. In addition, the ink container 12 may be removed from the printer chassis 38 for reasons other than an out of ink condition such as changing inks for an application requiring different ink properties or for use on different media. It is important that the ink container 12 be not only accessible within the printing system 10 but also easily replaceable. It is also important that the replacement ink container 12 form reliable mechanical engagement with the printer chassis 38 as well as properly form necessary interconnects such as fluid interconnect, air interconnect and electrical interconnect so that the printing system 10 performs reliably. The present invention is directed to a method and apparatus for reliably engaging the ink container 12 into the printer chassis 38 to insure proper interconnections are formed. The present invention provides an engaging system that is positive and provides tactile feedback to the user indicating the ink container 12 is properly inserted and secured within the print chassis 38.

It is important that ink spillage and spattering be minimized to provide reliable interconnection between the ink container 12 and printer 10. Ink spillage is objectionable not only for the operator of the printer who must handle the spattered ink container 12 but also from a printer reliability standpoint. Inks used in ink-jet printing frequently contain chemicals such as surfactants which if exposed to printer components can effect the reliability of these printer components. Therefore, ink spillage inside the printer can reduce the reliability of printer components thereby reducing the reliability of the printer.

Figure 3:
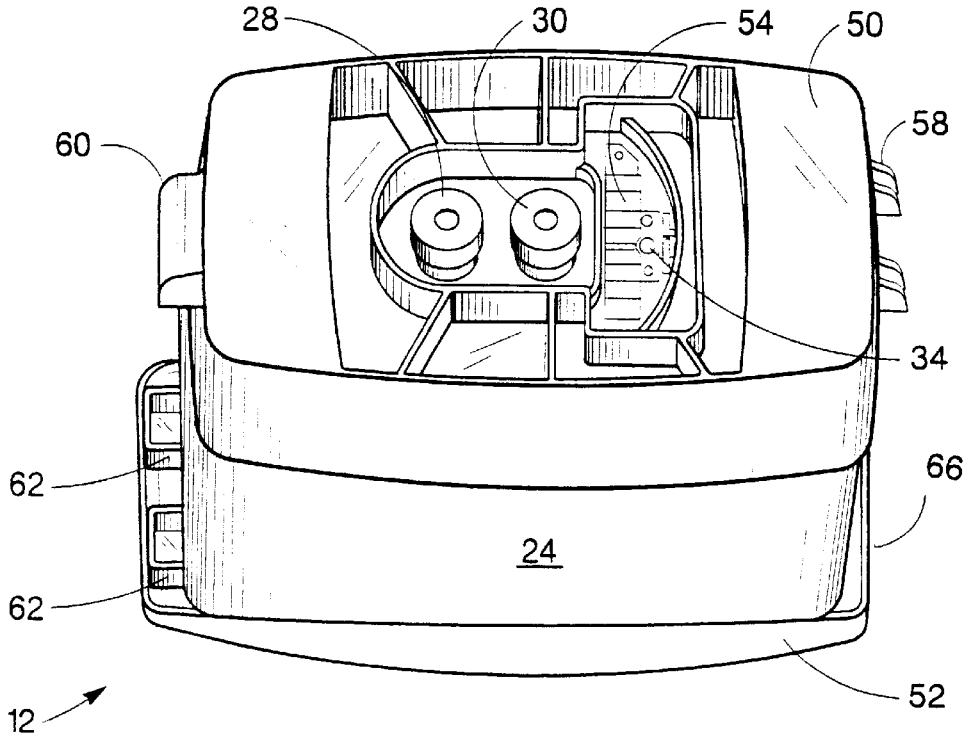
FIG. 3 depicts a perspective view of a leading edge portion of the ink container of the present invention.
Figure 4:
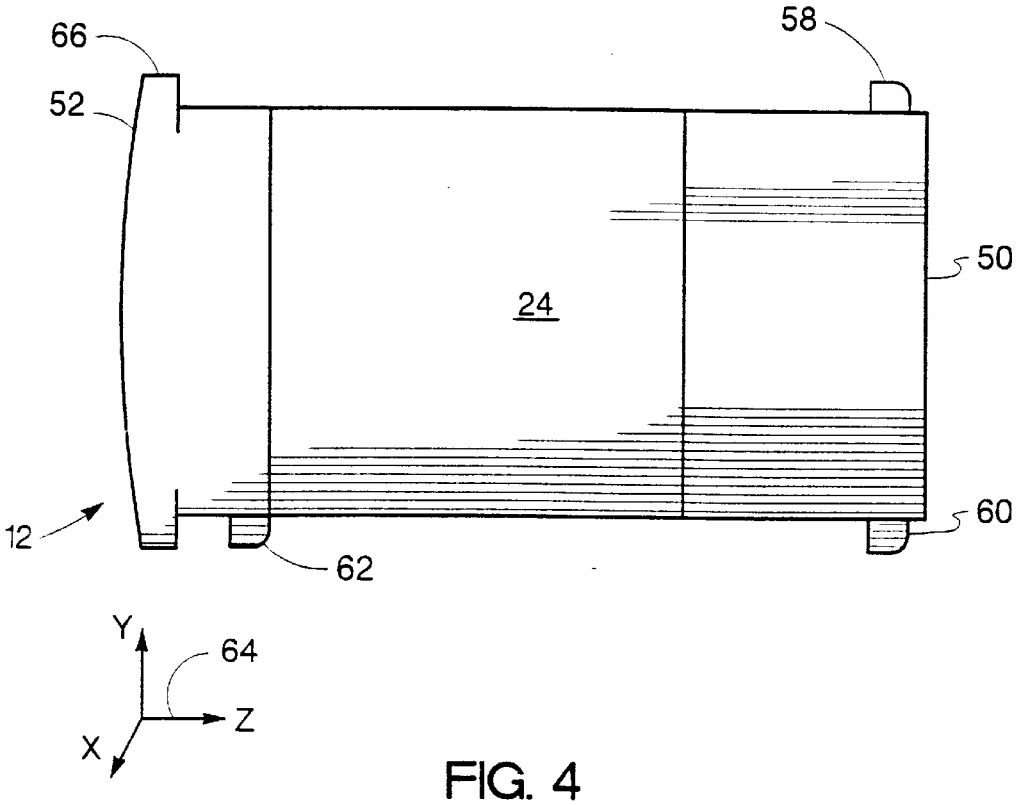
FIG. 4 depicts a side plan view of the ink container of the present invention.

FIGS. 3 and 4 depict the ink container 12 of the present invention. The ink container 12 includes a housing or outer shell 24 which contains the fluid reservoir 22 shown in FIG. 1 for containing ink 19. The outer shell 24 has a leading edge 50 and trailing edge 52 relative to a direction of insertion for the ink container 12 into the printer chassis 38. The leading edge 50 includes the air inlet 28 and the fluid outlet 30 which are configured for connection to the air pump 16 and the printhead 14, respectively, once the ink container 12 is properly inserted into the printer chassis 38. The air inlet 28 and fluid outlet 30 will be discussed in more detail with respect to FIG. 8. A plurality of electrical contacts 54 are disposed on the leading edge 50 for providing electrical connection between the ink container 12 and printer control electronics 32. In one preferred embodiment the plurality of electrical contacts 54 include a first plurality of electrical interconnects that are electrically interconnected to the information storage device 34 and a second plurality of electrical interconnects which are electrically interconnected to the ink volume sensing device 36 shown in FIG. 1. In the preferred embodiment the information storage device 34 is a semiconductor memory and the ink volume sensing device 36 is an inductive sensing device.

The ink container 12 includes one or more keying and guiding features 58 and 60 disposed toward the leading edge 50 of the ink container 12. The keying and guiding features 58 and 60 work in conjunction with corresponding keying and guiding features on the printer chassis 38 to assist in aligning and guiding the ink container 12 during insertion of the ink container 12 into the printer chassis 38. The keying and aligning features 58 and 60 in addition to providing a guiding function also provide a keying function to insure only ink containers 12 having proper ink parameters such as proper color and ink type are inserted into a given slot of the printer chassis 38. Keying and guiding features are discussed in more detail in co-pending patent application Ser. No. 08/566,521 filed Dec. 4, 1995 entitled "Keying System for Ink Supply Containers" assigned to the assignee of the present invention and incorporated herein by reference.

Latch features 62 are provided toward the trailing edge 52 of the ink container 12. The latch features 62 which are the subject of the present invention work in conjunction with corresponding latching features on the printer portion to secure the ink container 12 within the printer chassis 38 such that proper interconnects such as pressurized air, fluidic and electrical are accomplished in a reliable manner. Each latch feature 62 is a molded tang which extends downwardly relative to a gravitational frame of reference. The ink container 12 shown in FIG. 4 is positioned for insertion into a printer chassis 38 along the Z-axis of coordinate system 64. In this orientation gravitational forces act on the ink container 12 along the Y-axis.

At the trailing edge 52 of the ink container 12 is a flanged outer portion 66 which provides several functions. Firstly, the flanged portion 66 is larger than the insertion slot within the printer chassis 38 thereby preventing the ink container 12 from backward insertion. In addition, the flanged portion 66 provides a gripping portion for insertion of the ink container 12 into the printer chassis 38.

Figure 5:
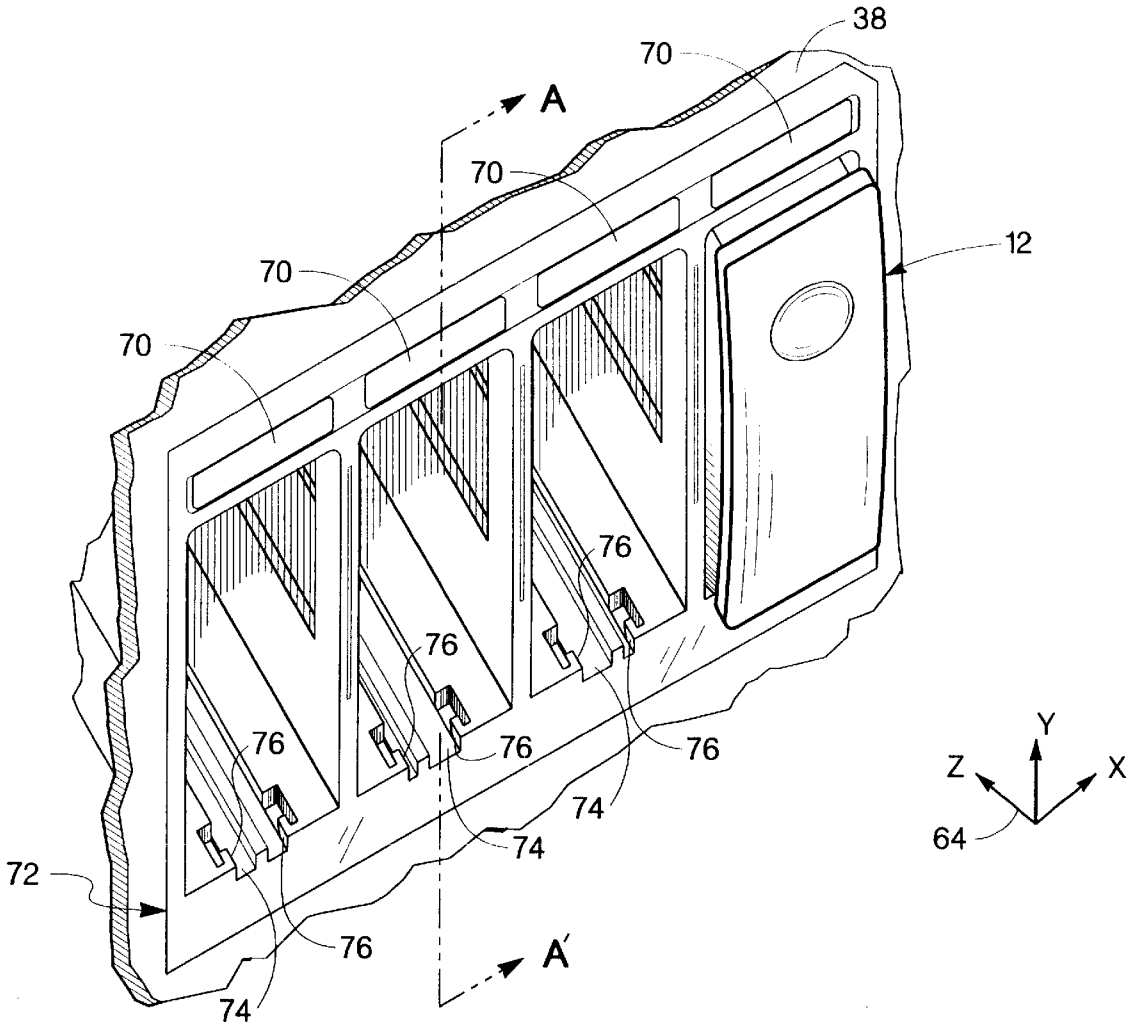
FIG. 5 depicts a perspective view of an ink container receiving station shown partially broken away with an ink container of the present invention installed.

FIG. 5 depicts an ink container 12 of the present invention shown secured within an ink container receiving station 72 within the printer chassis 38. Because ink container 12 is similar except for keying and guiding features 58 and 60 and corresponding ink properties contained within the respective fluid reservoir, the same reference numbering will be used for each ink container 12. An ink container indicia 70 may be positioned proximate each slot in the ink container receiving station 72. The ink container indicia 70 may be a color swatch or text indicating ink color to assist the user in color matching for inserting the ink container 12 in the proper slot within the ink container receiving station 72. As discussed previously the keying and guiding features 58 and 60 shown in FIGS. 3 and 4 prevent ink containers from being installed in the wrong slot. Installation of an ink container in the wrong slot can result in improper color mixing or the mixing of inks of different ink types each of which can result in poor print quality.

Each receiving slot within the ink container receiving station includes a corresponding keying and guiding slot 74 and recessed latching portions or latching features 76. The guiding slot 74 cooperates with the keying and guiding features 58 and 60 to guide the ink container 12 into the ink container receiving station 72. The keying and guiding slot 74 associated with the corresponding keying and guiding feature 60 is shown in FIG. 5 and the keying and guiding slot associated with the corresponding keying and guiding feature 58 on the ink container 12 is not shown. The latching features 76 are configured for engaging the corresponding latch features 62 on the ink container 12 as will be discussed in more detail with respect to FIGS. 6, 8 and 9.

Figure 6:
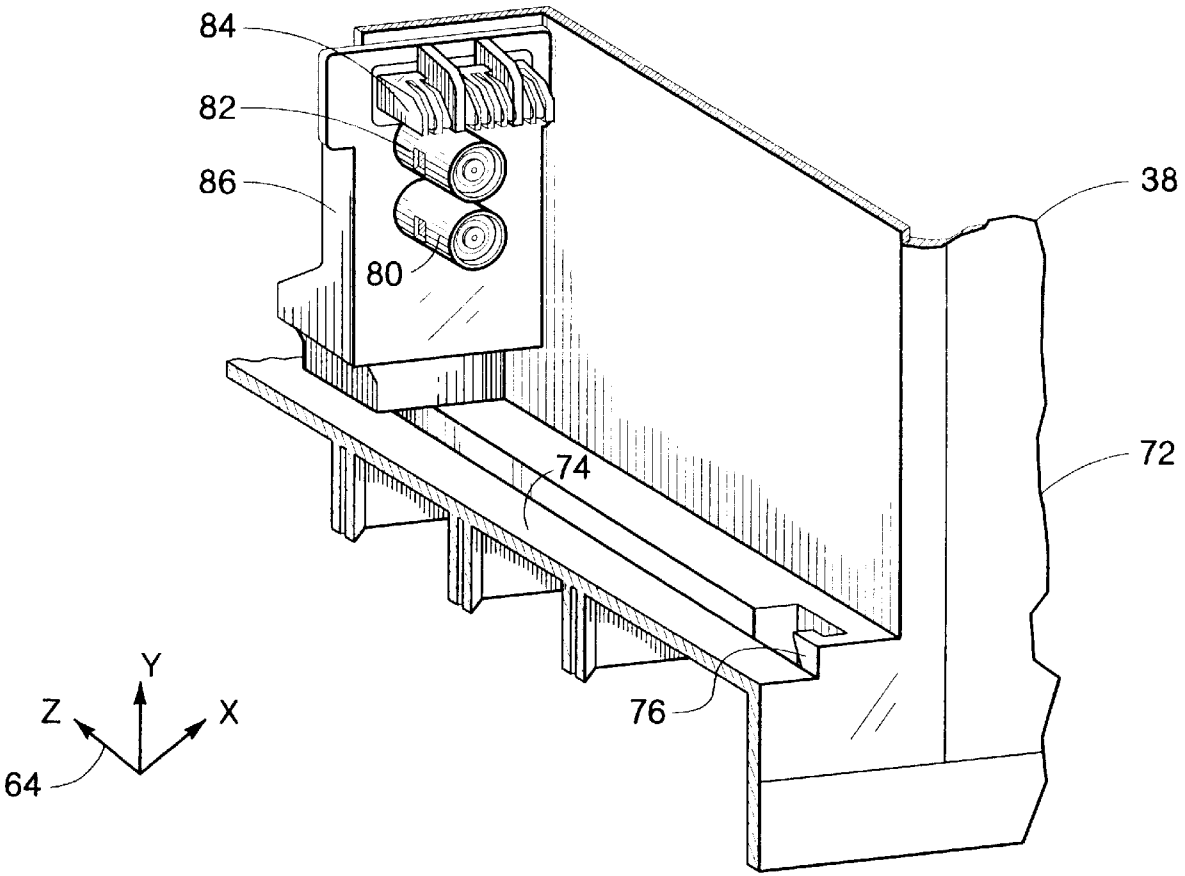
FIG. 6 depicts a cross-section taken across line A–A' of the ink container receiving station of FIG. 5 shown partially broken away.

FIG. 6 shows a cross-section of a single ink container receiving slot within the ink container receiving station 72. The ink container receiving slot includes interconnect portions for interconnecting with the ink container 12. In the preferred embodiment these interconnect portions include a fluid inlet 80, and air outlet 82 and an electrical interconnect 84. Each of the interconnects 80, 82, 84 are positioned on a floating interconnect portion 86 which is biased along the Z-axis toward the installed ink container 12.

The fluid inlet 80 and the air outlet 82 associated with the ink container receiving station 72 are configured for connection with the corresponding fluid outlet 30 and air inlet 28, respectively on the ink container 12. The electrical interconnect 84 is configured for engaging the plurality of electrical contacts 54 on the ink container 12.

It is the interaction between the keying and guiding features 58 and 60 associated with the ink container 12 and the corresponding keying and guiding feature 74 associated with the ink container receiving station 72 which guide the ink container 12 during the insertion such that proper interconnections are accomplished between the ink container 12 and the printer chassis 38. In addition, sidewalls associated with each slot in the ink container receiving station 72 engage corresponding sidewalls of the outer shell 24 of ink container 12 to assist in guiding and aligning the ink container 12 during insertion into the ink container receiving station 72.

Figure 7:
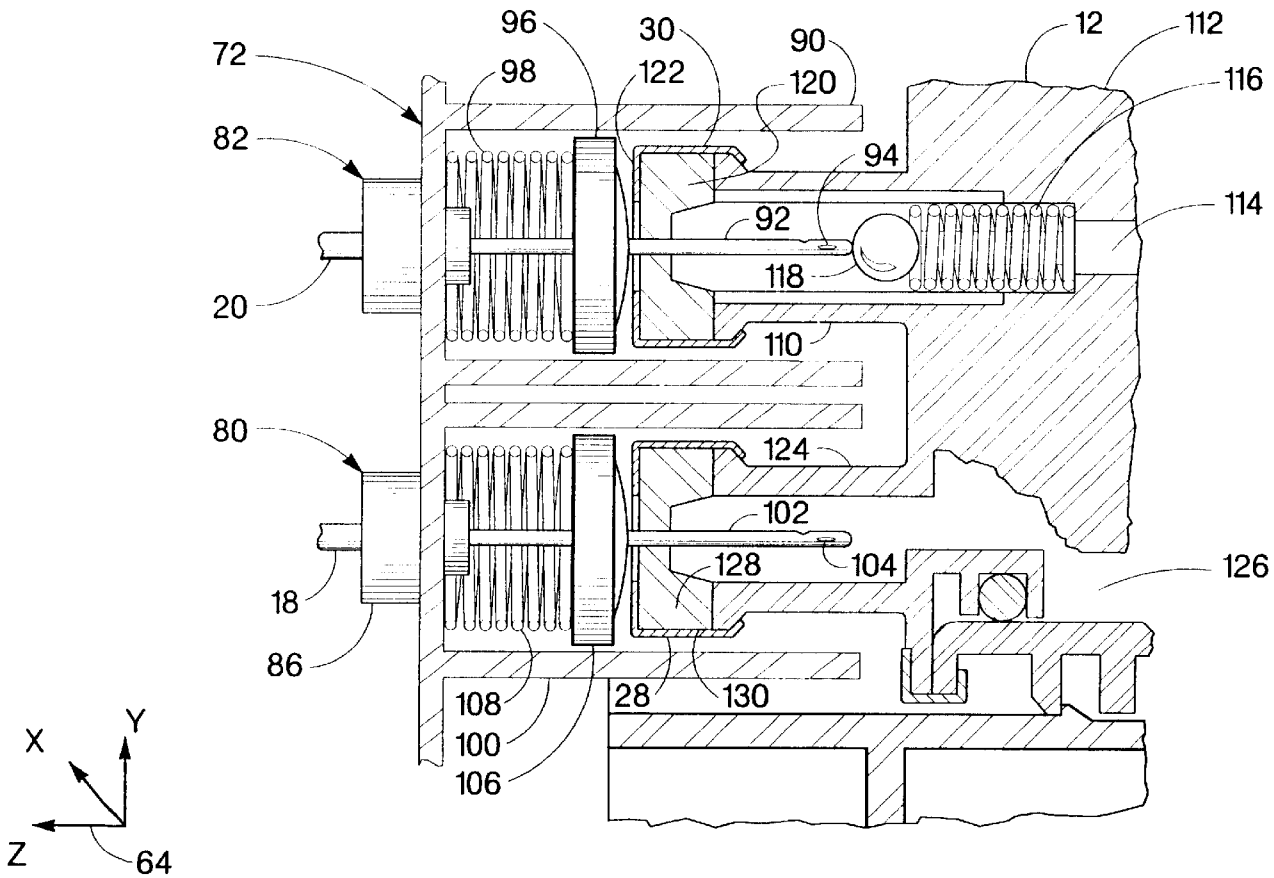
FIG. 7 depicts a cross section of a fluid outlet and an air inlet for the ink container of the present invention shown in engagement with a fluid inlet and air outlet, respectively, associated with the ink container receiving station shown in FIG. 5.

FIG. 7 illustrates further detail of the fluid outlet 30 and air inlet 28 associated with the ink container 12 and the corresponding fluid inlet 80 and air outlet 82 associated with the ink container receiving station 72.

In this preferred embodiment the fluid inlet 80 associated with the ink container receiving station 72 includes a housing 90 and outwardly extending needle 92 having a closed, blunt upper end, a blind bore (not shown) and a lateral hole 94. The blind bore is fluidly connected to the lateral hole 94. The end of the needle 92 opposite the lateral hole 94 is connected to the fluid conduit 20 for providing ink to the printhead 14 shown in FIG. 1. A sliding collar 96 surrounds the needle 92 and is biased upwardly by spring 98. The sliding collar 96 has a compliant sealing portion with an exposed upper surface and an inner surface in direct contact with the needle 92.

The air outlet 82 on the ink container receiving station 72 is similar to the fluid inlet 80. The air outlet 82 on the ink container receiving station 72 includes a housing 100 and outwardly extending needle 102 having a closed, blunt upper end, a blind bore (not shown) and a lateral hole 104. The blind bore is fluidly connected to the lateral hole 104. The end of the needle 102 opposite the lateral hole 104 is connected to the air conduit 18 for providing pressurized air to the ink container 12 shown in FIG. 1. A sliding collar 106 surrounds the needle 102 and is biased upwardly by spring 108. The sliding collar 106 has a compliant sealing portion with an exposed upper surface and an inner surface in direct contact with the needle 102. Alternatively, the sliding collar 106 and spring 108 can be eliminated because a fluid seal is not required at the air interface.

In this preferred embodiment, the fluid outlet 30 associated with the ink container 12 includes a hollow cylindrical boss 110 that extends outward from an ink container chassis 112. The end of the boss 110 toward the chassis 112 opens into a conduit 114 which is fluidly connected to the ink reservoir 22 thereby providing fluid to the fluid outlet 30. A spring 116 and sealing ball 118 are positioned within the boss 110 and held in place by a compliant septum 120 and a crimp cover 122. The spring 116 biases the sealing ball 118 against the septum 120 to form a fluid seal.

In the preferred embodiment, the air inlet 28 associated with the ink container 12 is similar to the fluid outlet 30 except that the additional seal formed by the spring 116 and sealing ball 118 are eliminated. The air inlet 28 associated with the ink container 12 includes a hollow cylindrical boss 124 that extends outward from an ink container chassis 112. The end of the boss 124 toward the chassis 112 opens into a conduit 126 which is in communication with a region between the outer shell 24 and an outer portion of the fluid reservoir 22 for pressurizing the fluid reservoir 22. A compliant septum 128 and a crimp cover 130 form a seal.

The insertion of the ink container 12 into the ink container receiving station 72 will now be discussed with respect to FIGS. 8A, 8B, 8C, and 8D. As shown in FIG. 8A the ink container 12 is inserted along an insertion direction corresponding to the Z-axis in coordinate system 64. During insertion the guiding and keying features 58 and 60 associated with the ink container 12 in conjunction with guiding and keying features 74 associated with the ink container receiving station 72 guide and align the proper ink container 12 into the ink container receiving station.

Figure 8B:
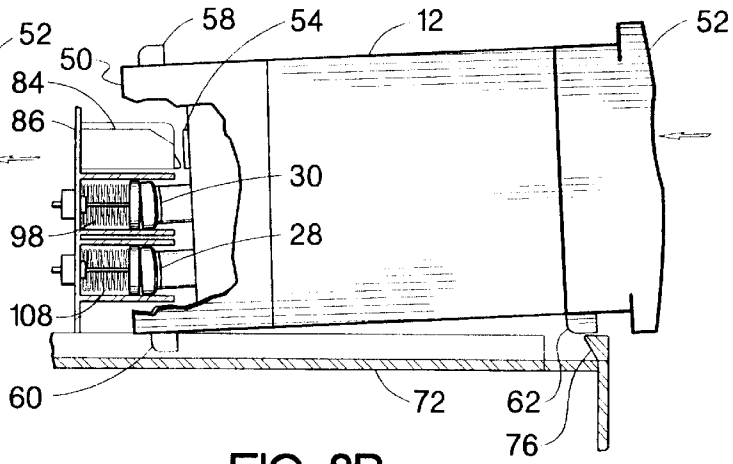
FIGS. 8A, 8B, 8C, and 8D depict a sequence of side plan views, shown partially broken away, illustrating the insertion and latching of the ink container of the present invention into the receiving station shown in FIG. 5.
Figure 8A:
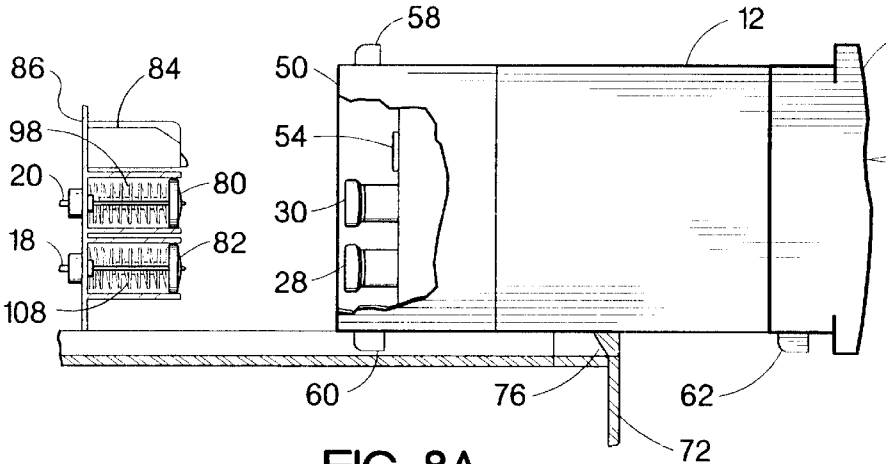

As shown in FIG. 8B the keying and guiding features 58 and 60 associated with the ink container 12 together with the keying and guiding features 74 associated with the ink container receiving station 72 align and guide the ink container 12 so that the fluid outlet 30 and air inlet 28 engage the corresponding fluid inlet 80 and air outlet 82, respectively, associated with the ink container receiving station 72.

As the ink container 12 is inserted into the ink container receiving station 72 the crimp caps 122 and 130 are guided into the internal bores of housings 90 and 100, respectively, by the keying and guiding features 58, 60 and 74. As the ink container 12 is further inserted, the alignment of the ink container 12 within the ink container receiving station 72 is then defined by the leading edge or crimp caps 122 and 130 and the internal bores of the housings 90 and 100, respectively. As the ink container 12 is pushed inward or sideways, along the z axis of coordinate system 64, into the receiving station 72 the crimp caps 122 and 130 engage the sealing members 96 and 106, respectively, compressing springs 98 and 108.

During insertion of the ink container 12 into the ink container receiving station 72, the outwardly extending needles 92 and 102 pierce the septums 120 and 128, respectively of the fluid outlet 30 and air inlet 28, receptively, of ink container 12. As needle 92 pierces the septum 120 of fluid outlet 30 and displaces the sealing ball 118 a fluid flow path is established from the ink reservoir 22 into the lateral hole 94 of the needle 92 through the blind bore and into the fluid conduit 20 to the printhead 14. Similarly, as needle 102 pierces the septum 128 of air inlet 28 an air flow path is established between the air pump 16 to a region between the ink container outer shell 24 and ink reservoir 22.

Figure 8D:
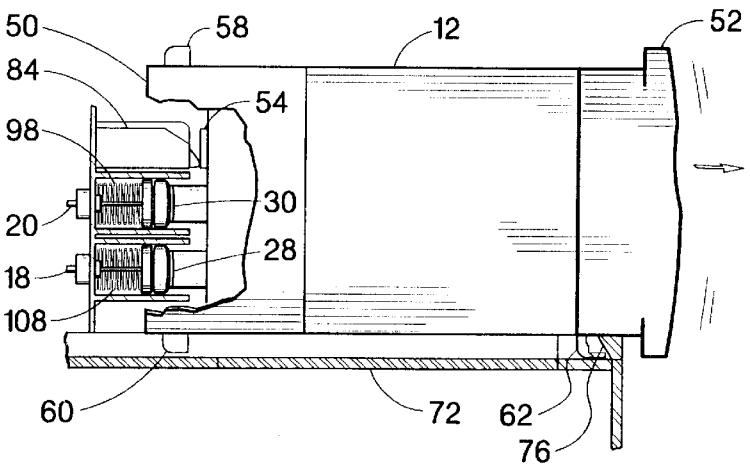
Figure 8C:
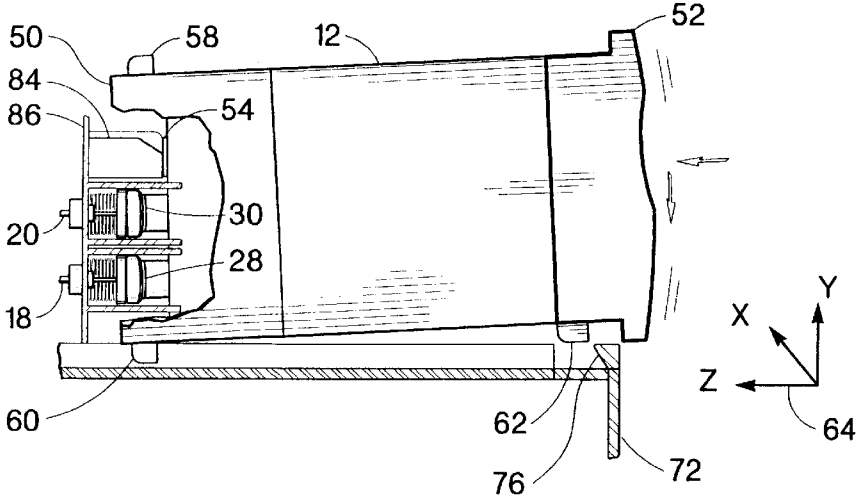

Once the ink container 12 is inserted into the ink container receiving station 72 such that the latch features 62 on the ink container 12 moves past the latching features 76 associated with the ink container receiving station 72 as shown in FIG. 8C, the ink container 12 drops downward along the y axis. As the ink container 12 drops down the springs 98 and 108 bias the ink container 12 in a direction opposite the insertion direction into a latched position such that the latch features (i.e. engagement features) 62 on the ink container 12 engage the latching features (i.e. recessed engagement features) 76 associated with the receiving station 72 as shown in FIG. 8D. In addition, the floating interconnect portion 86 is spring biased along the Z-axis opposite the insertion direction. Therefore, this spring force together with springs 98 and 108 tends to bias the ink container 12 such that the engagement features 62 and 76 engage.

The latch feature 62 is shown partially broken away to more clearly show the engagement of engagement features 62 and 76. Once in the latched position the ink container 12 is firmly secured in the ink container receiving station 72. In this latched position fluid communication between the fluid outlet 30 and fluid inlet 80 is established and communication between the air outlet 82 and air inlet 28 is established. In addition, in the latched position electrical connection is established between the plurality of electrical contacts 54 associated with the ink container 12 and the electrical interconnact 84 associated with the ink container receiving station 72.

Figure 9A:
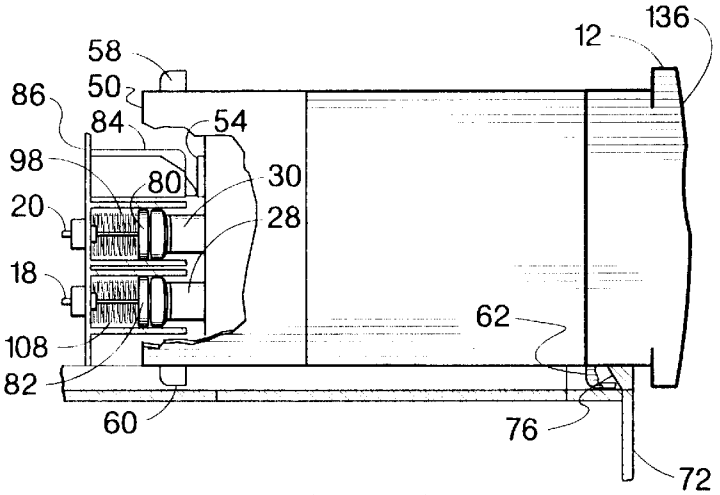
FIGS. 9A, 9B, 9C and 9D depict a sequence of side plan views, shown partially broken away, illustrating the removal of the ink container of the present invention from the receiving station.
Figure 9B:
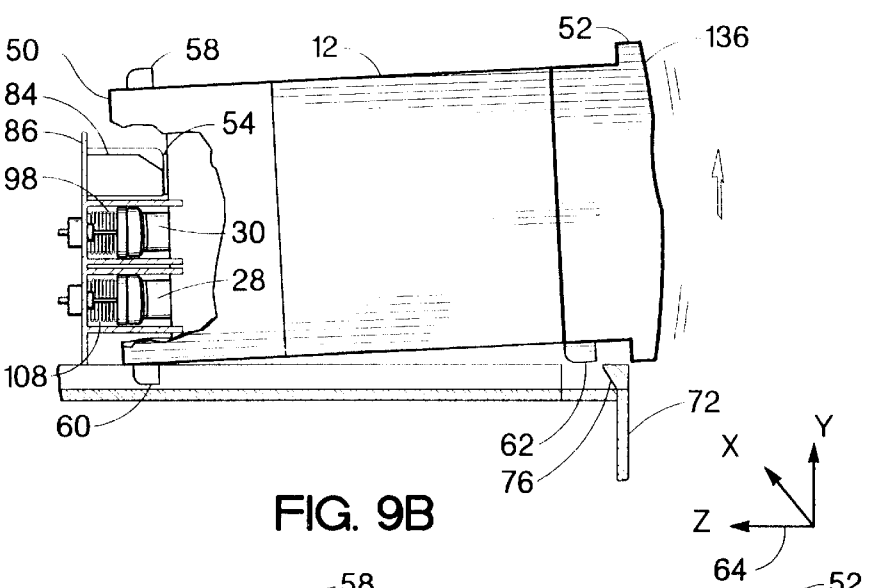
Figure 9C:
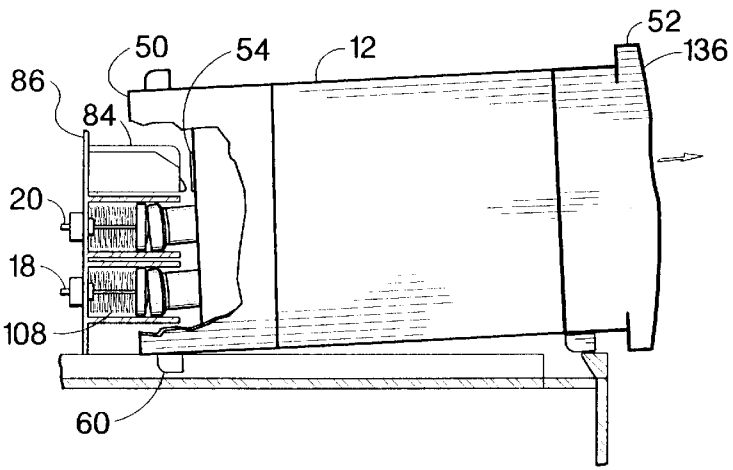
Figure 9D:
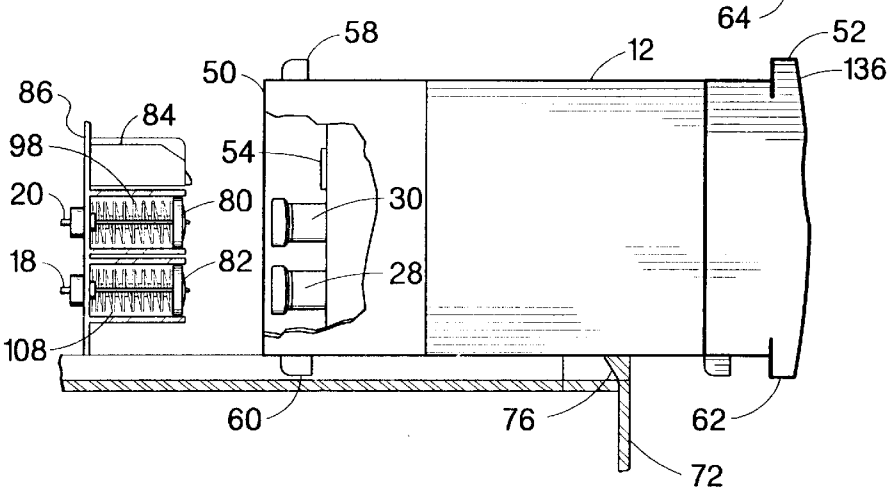

FIGS. 9A, 9B, 9C and 9D illustrates the removal of ink container 12 from the printer chassis 38. FIG. 9A shows the ink container in a latched position within the ink container receiving station 72. The application of a force at an upper portion 136 of the trailing edge 52 of the ink container 12 identified by a circular depression is used to release the ink container 12. This force, when applied in a direction along the direction of insertion, urges the ink container 12 inwardly, compressing springs 98 and 108, and moving the engagement feature 62 inwardly and away from the engagement feature 76. Because the force applied at the upper portion 136 creates an unbalanced force a torque results tending to lift the trailing edge 52 of the ink container 12 in an upward direction as shown in FIG. 9B. As the force applied at the upper portion 136 of the trailing edge is removed the force applied by the springs 98 and 108 tends to urge the ink container 12 outward in a direction opposite the direction of insertion as shown in FIG. 9C. As the ink container 12 is urged outward from the ink container receiving station 72 the engagement portion 62 moves up and over the engagement portion 76 allowing removal of the ink container 12 from the ink container receiving station 72 as shown in FIG. 9D.

The method and apparatus for securing the ink container 12 of the present invention provides a reliable technique for securing the ink container 12 within the ink container receiving station 72. This technique secures the ink container so that reliable interconnections such as fluid, air and electrical interconnects are formed between the ink container 12 and the printer portion. This technique of the present invention provides for an insertion and removal of the ink container which is quick and easily accomplished by the user.

What is claimed is:

1. An ink container for insertion into an ink container receiving station within a printer, the ink container receiving station including an interconnect portion, the ink container comprising:

a functional interface for engaging the interconnect portion of the ink container receiving station to functionally interconnect the printer with the ink container, a guide feature wherein between initial contact of the ink container with the ink container receiving station and full installation of the ink container in the ink container receiving station, the guide feature allows the ink container to move relative to the ink container receiving station with a combination of linear and pivotal movement; and a first engagement feature on the ink container that retains the ink container within the ink container receiving station.

2. The ink container of claim 1, wherein the ink container receiving station includes a second engagement feature and wherein the first engagement feature on the ink container is a latch that engages with the second engagement feature on the ink container receiving station to retain the ink container within the ink container receiving station.

3. The ink container of claim 2, wherein the second engagement feature is recessed within the ink container receiving station, the latch extends outwardly from the ink container to be received within the recessed second engagement feature.

4. The ink container of claim 1, further comprising an ink supply coupled to the ink container to provide ink to the printer.

5. The ink container of claim 1, wherein the printer further includes a carriage supporting a printhead.

6. The ink container of claim 1, wherein the ink container is outwardly biased by a spring on the floating interconnect portion, the functional interface of the ink container causes compression of the spring when the ink container is properly installed in the ink container receiving station.

7. The ink container of claim 6, wherein the ink container has a leading edge relative to a direction of insertion of the ink container into the ink container receiving station, the leading edge comprises the functional interface.

8. The ink container of claim 6, wherein the first engagement feature on the ink container opposes and cancels a force generated by compression of the spring when the ink container is installed into the ink container receiving station.

9. The ink container of claim 1, wherein the ink container includes an outer shell, the first engagement feature on the ink container is formed by a portion of the outer shell.

10. The ink container of claim 1, wherein the ink container includes an outer shell, the first engagement feature on the ink container extends outwardly from the outer shell.

11. The ink container of claim 9, wherein the ink container has a trailing edge relative to the insertion of the ink container into the ink container receiving station and wherein the first engagement feature on the ink container is adjacent the trailing edge.

12. The ink container of claim 9, wherein the functional interface on the ink container functionally interconnects fluid, air and electrical between the interconnect portion of the printer and the ink container.

13. A method for securing an ink container to an ink container receiving station within a printing device, the ink container receiving station including an interconnect portion, comprising:

inserting the ink container into the ink container receiving station such that between initial contact of the ink container with the ink container receiving station and full installation of the ink container in the ink container receiving station, the ink container moves relative to the ink container receiving station with a combination of linear and pivotal movement, and a functional interface on the ink container engages the interconnect portion to functionally interconnect the printing device with the ink container; and retaining the ink container within the ink container receiving station.

14. The method of claim 13, wherein the ink container receiving station includes an engagement feature and the ink container has a latch that engages with the engagement feature.

15. The method of claim 14, wherein the latch is urged against the engagement feature on the ink container receiving station to resiliently retain the ink container within the ink container receiving station.

16. A printing system, comprising:

an ink container receiving station;

an ink container insertable into the ink container receiving station, the ink container including a functional interface;

an interconnect portion on the ink container receiving station engageable with the functional interface of the ink container for functionally interconnecting the printing system with the ink container upon full installation of the ink container in the ink container receiving station;

a guide feature of the ink container receiving station, wherein between initial contact of the ink container with the ink container receiving station and full installation of the ink container in the ink container receiving station, the guide feature allows the ink container to move relative to the ink container receiving station with a combination of linear and pivotal movement; and a biasing mechanism urging the ink container against the ink container receiving station to retain the ink container within the ink container receiving station.

17. An ink container for insertion into an ink container receiving station within a printer, the ink container receiving station including an interconnect portion including a spring biasing mechanism, the ink container comprising:

a housing having a leading edge and an opposing trailing edge;

a functional interface on the leading edge for engaging the interconnect portion to functionally interconnect the printer with the ink container, the functional interface causing compression of the spring biasing mechanism when the ink container is properly installed within the ink container receiving station;

a guide feature wherein between initial contact of the ink container with the ink container receiving station and proper installation of the ink container in the ink container receiving station, the guide feature allows the ink container to move relative to the ink container receiving station with a combination of linear and pivotal movement; and a first engagement feature on the ink container that opposes compression of the spring biasing mechanism when the ink container is properly installed within the ink container receiving station.

18. The ink container of claim 17, wherein the first engagement feature is a latch located on the opposing trailing edge of the ink container.

19. The ink container of claim 17, further comprising an ink reservoir containing ink located within the housing.

20. The ink container of claim 17, wherein the first engagement feature extends outwardly from the housing.

21. The ink container of claim 17, wherein the functional interface on the ink container functionally interconnects fluid, air and electrical between the interconnect portion of the printer and the ink container.

* * * * *

UNITED STATES PATENT AND TRADEMARK OFFICE

CERTIFICATE OF CORRECTION

PATENT NO. : 6,209,996 B1
DATED : April 3, 2001
INVENTOR(S) : Eric L. Gasvoda et al.

It is certified that error appears in the above-identified patent and that said Letters Patent is hereby corrected as shown below:

Column 9,
Line 28, "Claim 9" should read -- Claim 1 --;
Line 29, "has a trailing edge to the insertion of the ink" should read -- has a trailing edge relative to a direction of insertion of the ink --;
Line 33, "Claim 9" should read -- Claim 1 --;

Signed and Sealed this

Eighth Day of January, 2002

*Attest:*

*Attesting Officer*

JAMES E. ROGAN
*Director of the United States Patent and Trademark Office*